US010928765B2

(12) United States Patent
Suzuki et al.

(10) Patent No.: US 10,928,765 B2
(45) Date of Patent: Feb. 23, 2021

(54) IMAGE FORMING APPARATUS DETERMINING STATES OF MEMBERS, IMAGE FORMING METHOD, AND IMAGE FORMING SYSTEM

(71) Applicant: CANON KABUSHIKI KAISHA, Tokyo (JP)

(72) Inventors: Yohei Suzuki, Mishima (JP); Junya Azami, Mishima (JP); Seiji Hara, Suntou-gun (JP); Atsunobu Mori, Suntou-gun (JP); Masafumi Monde, Kawasaki (JP); Tatsuya Hotogi, Meridian, ID (US); Hirotaka Shiomichi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/818,714

(22) Filed: Mar. 13, 2020

(65) Prior Publication Data

US 2020/0310318 A1 Oct. 1, 2020

(30) Foreign Application Priority Data

Mar. 26, 2019 (JP) ..... JP2019-058899

(51) Int. Cl.
*G03G 15/00* (2006.01)

(52) U.S. Cl.
CPC ..... *G03G 15/5062* (2013.01)

(58) Field of Classification Search
CPC ..... G03G 15/5062
See application file for complete search history.

(56) References Cited

U.S. PATENT DOCUMENTS

| | | | | |
|---|---|---|---|---|
| 9,216,876 | B2 * | 12/2015 | Suzuki | B65H 31/20 |
| 9,712,701 | B2 * | 7/2017 | Yamamoto | H04N 1/00615 |
| 2007/0177887 | A1 * | 8/2007 | Haas | G03G 15/607 399/17 |
| 2009/0097870 | A1 | 4/2009 | Misumi et al. | |
| 2012/0183313 | A1 | 7/2012 | Kurimoto et al. | |
| 2015/0309459 | A1 | 10/2015 | Watanabe et al. | |

(Continued)

FOREIGN PATENT DOCUMENTS

| | | | |
|---|---|---|---|
| JP | 2004-226482 | A | 8/2004 |
| JP | 2008-092358 | A | 4/2008 |

(Continued)

OTHER PUBLICATIONS

Extended European Search Report dated Aug. 18, 2020, in European Patent Application No. 20160032.7.

*Primary Examiner* — Sevan A Aydin
(74) *Attorney, Agent, or Firm* — Venable LLP

(57) ABSTRACT

An image forming apparatus includes a plurality of members for forming an image; a transmitting unit configured to transmit a sonic wave; a receiving unit configured to receive a first sonic wave that has been transmitted from the transmitting unit and has passed through a sheet and a second sonic wave that is generated from at least one of the plurality of members; a detection unit configured to detect information regarding a type or state of the sheet based on the first sonic wave; and a determination unit configured to determine a state of a member that has generated the second sonic wave based on the second sonic wave.

22 Claims, 13 Drawing Sheets

(56) References Cited

U.S. PATENT DOCUMENTS

| | | | | |
|---|---|---|---|---|
| 2016/0077478 | A1* | 3/2016 | Yamamoto | G03G 15/5025 399/45 |
| 2016/0147187 | A1* | 5/2016 | Muramoto | G03G 15/55 399/9 |
| 2017/0017181 | A1 | 1/2017 | Watanabe et al. | |
| 2018/0356282 | A1 | 12/2018 | Fukuda et al. | |
| 2019/0187601 | A1* | 6/2019 | Seki | G03G 15/55 |
| 2019/0291984 | A1 | 9/2019 | Fukumasu et al. | |
| 2020/0004194 | A1* | 1/2020 | Noguchi | G03G 21/0011 |

FOREIGN PATENT DOCUMENTS

| | | | |
|---|---|---|---|
| JP | 2011-037524 | A | 2/2011 |
| JP | 2016-055933 | A | 4/2016 |
| JP | 2019-167231 | A | 10/2019 |

* cited by examiner

FIG. 4

| DETERMINATION TARGET ABNORMAL SOUND | SOUND COLLECTING TIMING | FILTER | CRITERION | NUMBER OF DETERMINATION Nth | NUMBER OF RELEASES Mth | PROCESSING DETAILS WHEN ANOMALY IS DETERMINED |
|---|---|---|---|---|---|---|
| FEEDING UNIT ABNORMAL SOUND | WHILE RECORDING MATERIAL IS BEING DRAWN OUT FROM FEEDING UNIT, WITH ELECTROMAGNETIC CLUTCH OFF | UP TO 500Hz | >41dB | 3 | 10 | EXTEND TIME WHILE ELECTROMAGNETIC CLUTCH IS ON ; DISPLAY OF FEEDING UNIT REPLACEMENT; NOTIFY SERVICE CENTER VIA NETWORK |
| ROLLER BEARING ABNORMAL SOUND | BEFORE RECORDING MATERIAL FEEDING / TEMPORARILY STOPPING AFTER FEEDING / AFTER PASSAGE OF RECEIVING UNIT | 5kHz TO 10kHz | >30dB | 2 | 2 | DISPLAY OF ROLLER UNIT REPLACEMENT ; NOTIFY SERVICE CENTER VIA NETWORK |
| ROLLER CONTACT ABNORMAL SOUND | | | >23dB, PERIODICITY | 2 | 3 | |
| CLEANING UNIT ABNORMAL SOUND | | UP TO 500Hz | >23dB | 3 | 5 | DISPLAY OF CLEANING UNIT REPLACEMENT ; NOTIFY SERVICE CENTER VIA NETWORK |

IMAGE FORMING APPARATUS DETERMINING STATES OF MEMBERS, IMAGE FORMING METHOD, AND IMAGE FORMING SYSTEM

BACKGROUND OF THE INVENTION

Field of the Invention

The present invention relates to an image forming apparatus that determines whether a specific sound is occurring when being in operation, an image forming method, and an image forming system.

Description of the Related Art

Image forming apparatuses such as a copier and a laser printer include replacement components that are to be replaced due to their lifetimes. When a replacement component is used in a period exceeding its lifetime, a specific sound may be generated or the sound may change according to the state of the component. For example, in a feeding unit that feeds sheets to a conveyance path, as a result of the outer diameter and the surface property of the roller changing due to wear-out of its roller surface, a specific sound is generated. The generation of a specific sound is one of the signs indicating that a replacement component is used past its lifetime and a failure may occur; therefore, it is desired that the generation of a specific sound is determined and a replacement component that generates the specific sound is specified.

Japanese Patent Laid-Open No. 2004-226482 discloses a configuration in which a sound collector is arranged inside an image forming apparatus, and a component that generates a specific sound is detected by comparing a sound collected by the sound collector with the sound in a normal state.

Japanese Patent Laid-Open No. 2016-55933 discloses a configuration in which an ultrasonic wave is transmitted from a transmitting unit, and a receiving unit receives an ultrasonic wave that has passed through a sheet, and as a result information regarding the sheet is detected.

However, if both of the configuration in which a specific sound is detected in order to determine the state of a member, as in Japanese Patent Laid-Open No. 2004-226482, and the configuration in which information regarding a sheet is detected, as in Japanese Patent Laid-Open No. 2016-55933, are provided in an apparatus, the following problems are incurred. First, the space for accommodating both of the configurations inside the apparatus increases. Also, the number of components of the apparatus increases. Moreover, the cost of the apparatus increases.

SUMMARY OF THE INVENTION

According to an aspect of the present invention, an image forming apparatus includes: a plurality of members for forming an image; a transmitting unit configured to transmit a sonic wave; a receiving unit configured to receive a first sonic wave that has been transmitted from the transmitting unit and has passed through a sheet and a second sonic wave that is generated from at least one of the plurality of members; a detection unit configured to detect information regarding a type or state of the sheet based on the first sonic wave; and a determination unit configured to determine a state of a member that has generated the second sonic wave based on the second sonic wave.

Further features of the present invention will become apparent from the following description of exemplary embodiments with reference to the attached drawings.

BRIEF DESCRIPTION OF THE DRAWINGS

FIG. 4 is a diagram illustrating determination information according to one embodiment.

DESCRIPTION OF THE EMBODIMENTS

Figure 1:
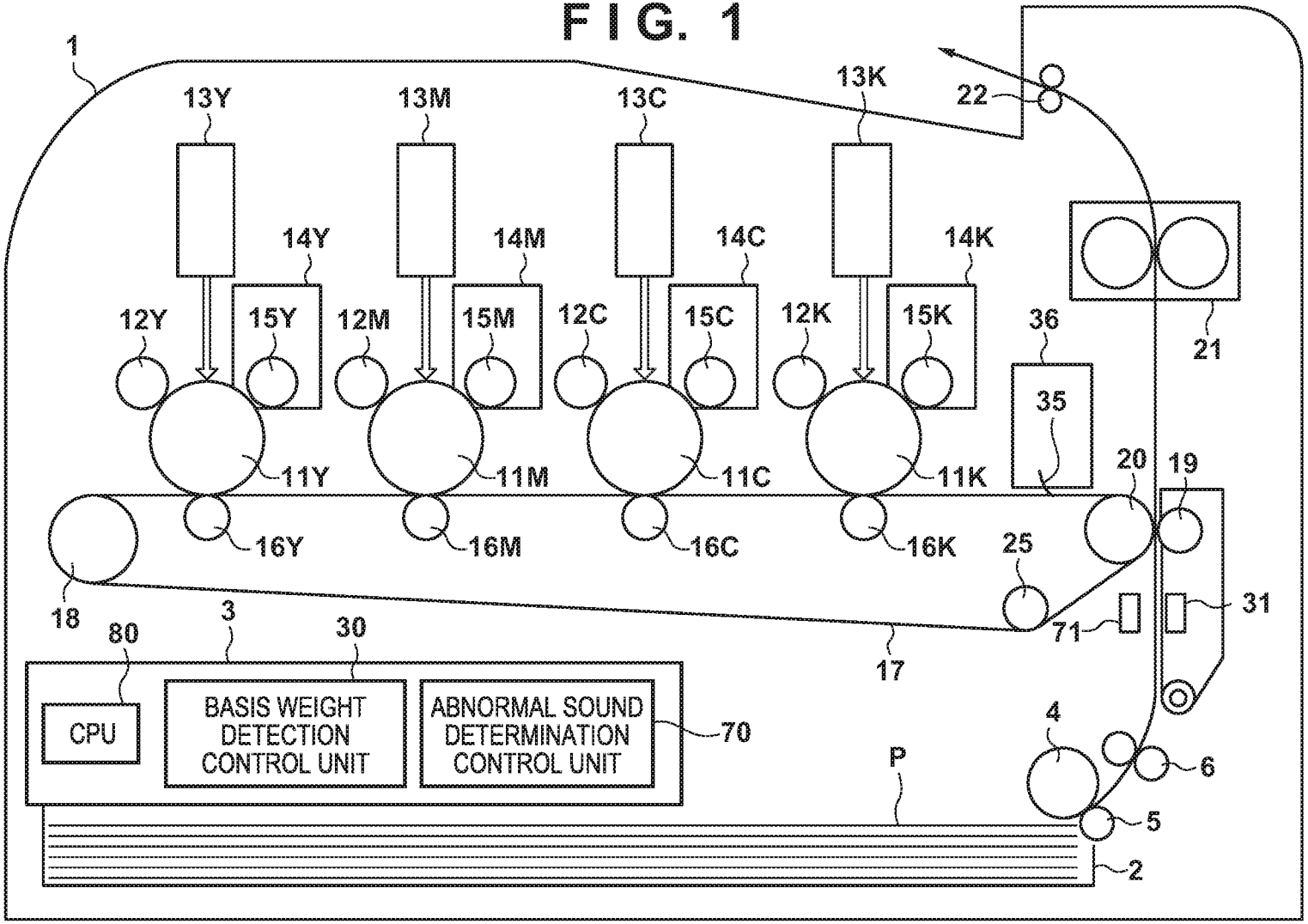
FIG. 1 is a configuration diagram of an image forming apparatus according to one embodiment.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are assigned to the same or similar configurations, and redundant description thereof is omitted.

First Embodiment

FIG. 1 is a configuration diagram of an image forming apparatus 1 in the present embodiment. In FIG. 1, Y, M, C, and K at the end of reference signs respectively indicate that the colors of toner to which members denoted by these reference signs are related when an image is formed are yellow, magenta, cyan, and black. Note that the following description will use reference signs without Y, M, C, and K at the end in cases where the colors do not need to be distinguished. A photoconductive member 11, which is an image carrier, is rotationally driven in the clockwise direction in the diagram when an image is formed. A charging roller 12 charges the surface of the photoconductive member 11 at a predetermined potential. An optical unit 13 forms an electrostatic latent image on the photoconductive member 11 by exposing the photoconductive member 11 with light. A developing device 14 has developer, and forms a developer image (image) by developing the electrostatic latent image on the photoconductive member 11 using a developing roller 15. A primary transfer roller 16 outputs a primary transfer bias, and forms the developer image on an intermediate transfer belt 17, which is an image carrier, by transferring the developer image on the photoconductive member 11 to the intermediate transfer belt 17. Note that a full-color developer image is formed on the intermediate transfer belt 17 by transferring developer images formed on the respective photoconductive members 11Y, 11M, 11C, and 11K to the intermediate transfer belt 17 so as to be overlaid thereon.

The intermediate transfer belt 17 is extended between a driving roller 18, a tension roller 25, and a secondary transfer counter roller 20, and is rotationally driven, following the rotation of the driving roller 18, in the counterclockwise direction in the diagram when an image is formed. With this, the developer image transferred to the intermediate transfer belt 17 is conveyed to a position opposing a secondary transfer roller 19. Meanwhile, a recording material (sheet) P stored in a cassette 2 is fed to a conveyance path by a feeding roller 4. A separation roller 5 separates the recording materials P sheet by sheet when the recording materials P are fed from the cassette 2. The feeding roller 4 and the separation roller 5 constitute a feeding unit. In a period in which an unshown electromagnetic clutch is in an ON state, a rotary driving force from an unshown motor is transmitted to the feeding roller 4, and with this, the feeding roller 4 is rotationally driven. In a period in which the electromagnetic clutch is in an OFF state, transmission of the rotary driving force from the unshown motor to the feeding roller 4 is cut off. A conveyance roller pair 6 conveys the fed recording material P downstream of the conveyance path, that is, toward a position opposing the secondary transfer roller 19. The secondary transfer roller 19 outputs a secondary transfer bias, and transfers the developer image on the intermediate transfer belt 17 to the recording material P. Note that the developer that remains on the intermediate transfer belt 17 without being transferred to the recording material P is collected to a cleaning unit 36 by a cleaning blade 35. After the developer image is transferred, the recording material P is conveyed to a fixing device 21. The fixing device 21 fixes the developer image on the recording material P by heating and pressing the recording material P. After the developer image is fixed, the recording material P is discharged outside of the image forming apparatus 1 by a discharging roller pair 22. Note that the roller pairs including the conveyance roller pair 6 and the discharging roller pair 22 are configured as a roller unit.

The image forming apparatus 1 includes a transmitting unit 31 that transmits an ultrasonic wave and a receiving unit 71 that receives a sonic wave including an ultrasonic wave. Note that the transmitting unit 31 and the receiving unit 71 are respectively arranged on sides opposite to each other relative to the conveyance path of the recording material P, and the ultrasonic wave that has been transmitted from the transmitting unit 31 and has passed through the conveyance path of the recording material P is received by the receiving unit 71. For example, the transmitting unit 31 includes a piezoelectric element, which is a mutual converting element between a mechanical displacement and an electric signal. Also, the receiving unit 71 includes a MEMS (Micro Electro Mechanical System) microphone that converts the vibration displacement of a diaphragm due to pressure to a change in voltage, and outputs the voltage. Note that, if both of an ultrasonic wave and a sonic wave in an audible range are allowed to be received, a microphone, other than the MEMS microphone, such as a condenser microphone can also be used.

Figure 15:
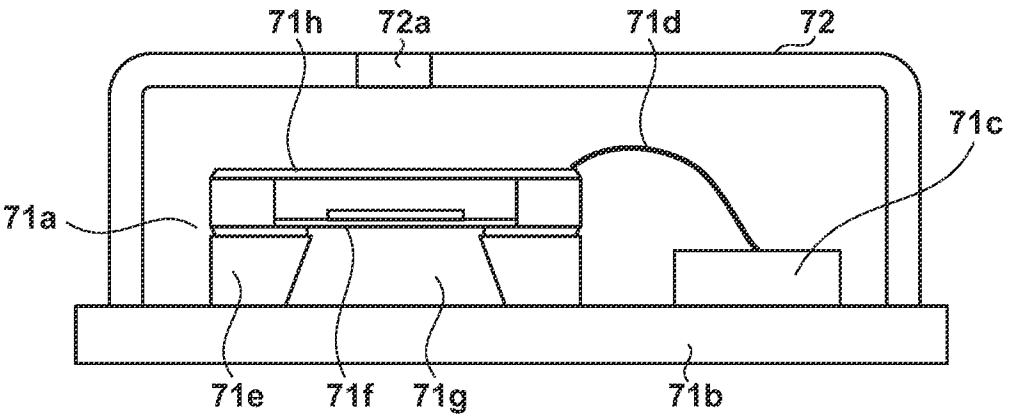
FIG. 15 is a diagram illustrating a cross-sectional view of a MEMS microphone according to one embodiment.

FIG. 15 is a cross-sectional view illustrating an example of the MEMS microphone in the receiving unit 71. A MEMS chip 71*a* and an amplifier circuit 71*c* are provided on a substrate 71*b*. The MEMS chip 71*a* and the amplifier circuit 71*c* are shielded by a shield case 72. Note that the shield case 72 is provided with a sound hole 72*a* for taking in a sonic wave from the outside. The MEMS chip 71*a* and the amplifier circuit 71*c* are electrically connected by a wire 71*d*. The MEMS chip 71*a* includes a vibrating membrane 71*f* formed above a silicon substrate 71*e* and a back electrode 71*h* that is provided so as to oppose the vibrating membrane 71*f* and includes a plurality of sound holes. The vibrating membrane 71*f* and the back electrode 71*h* that oppose each other form a capacitor. Note that a cavity 71*g* is provided in the silicon substrate 71*e*, and the vibrating membrane 71*f* is provided so as to cover the cavity 71*g*. A sonic wave enters through the sound hole 72*a* provided in the shield case 72, the vibrating membrane 71*f* vibrates, and an electric signal corresponding to the vibrating state is output. Specifically, the back electrode 71*h* converts the change in capacitance, of the capacitor formed between the vibrating membrane 71*f* and the back electrode 71*h*, that is caused by the vibration of the vibrating membrane 71*f* to the electric signal. The electric signal is subjected to amplification processing by the amplifier circuit 71*c*, and is output to the outside of the MEMS microphone.

Figure 16:
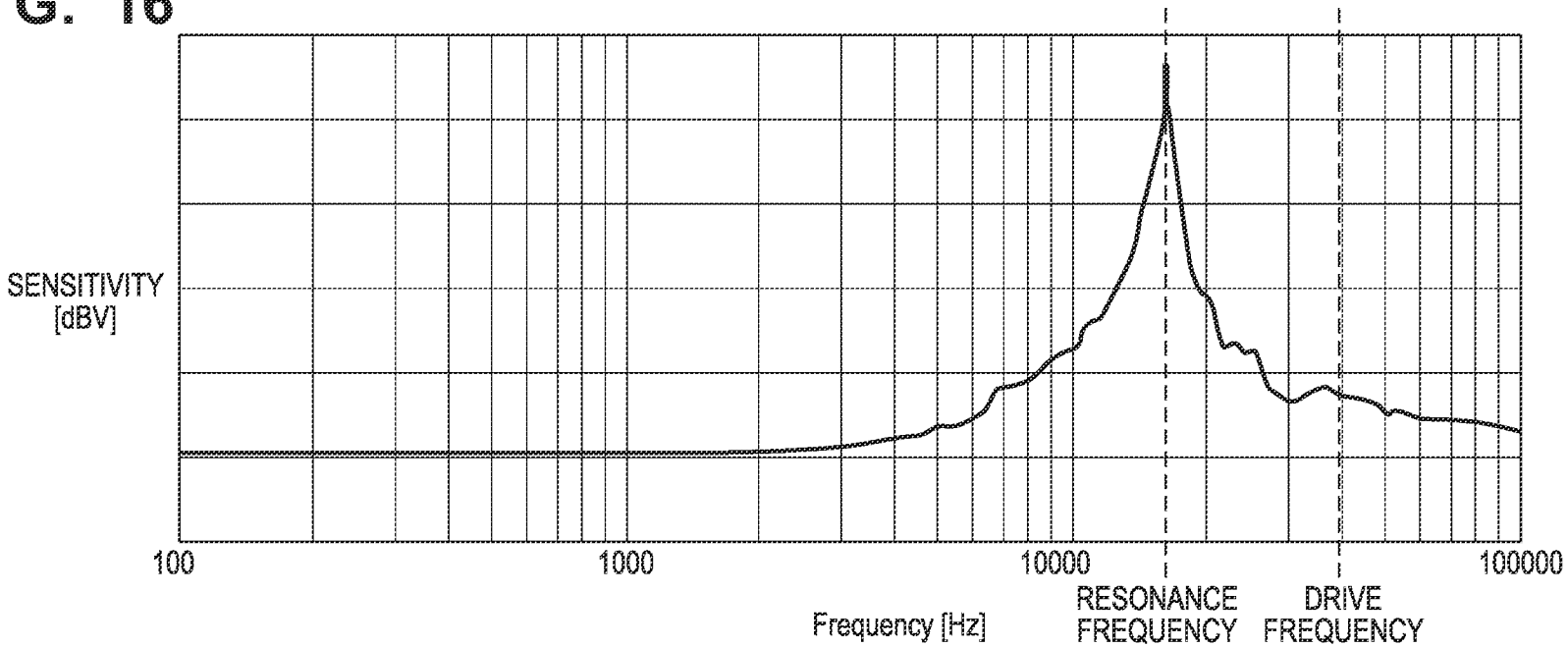
FIG. 16 is a diagram illustrating a frequency characteristic of the MEMS microphone according to one embodiment.

FIG. 16 shows an illustrative frequency characteristic of the receiving unit 71 of the present embodiment. The horizontal axis in FIG. 16 shows the frequency of an input sonic wave, and the vertical axis shows the sensitivity. In the example in FIG. 16, the receiving unit 71 has a resonance frequency of about 15 kHz. However, the receiving unit 71 is sensitive in a frequency zone other than the resonance frequency, and can detect a sonic wave in a frequency zone other than the resonance frequency. That is, the receiving unit 71 can be used in a frequency band other than the resonance frequency, at which the output converges in a relatively short period of time.

Returning to FIG. 1, the control unit 3 includes a CPU 80 that performs overall control on the image forming apparatus 1. Also, the control unit 3 includes a basis weight detection control unit 30 and an abnormal sound determination control unit 70, which will be described later. Note that the abnormal sound determination control unit 70 may be provided in a processing system or an apparatus that can communicate with the image forming apparatus 1 via a network, instead of being provided inside the image forming apparatus 1.

Figure 2:
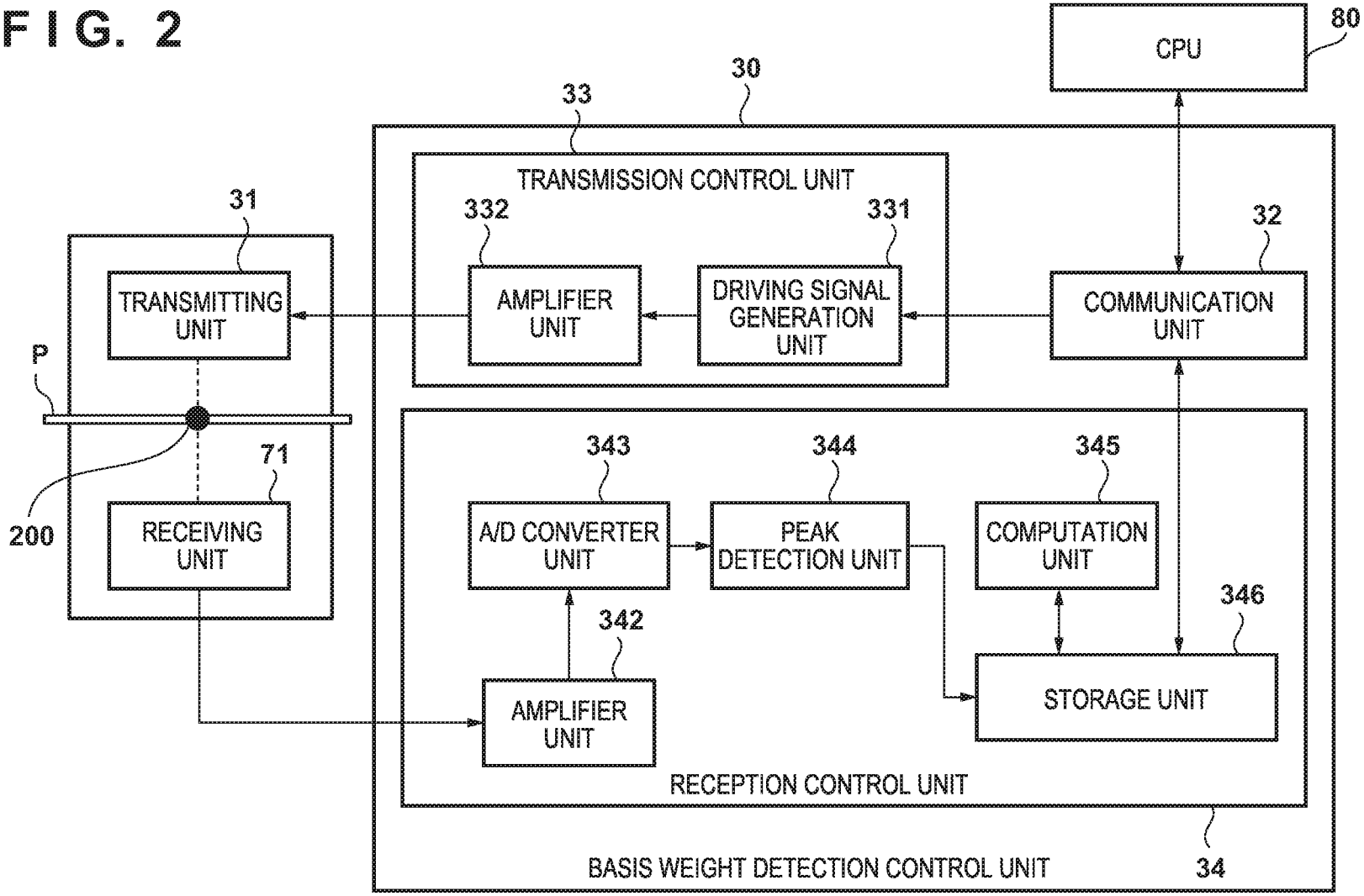
FIG. 2 is a block diagram of a basis weight detection control unit according to one embodiment.

FIG. 2 is a block diagram of the basis weight detection control unit 30. Note that the basis weight is a mass per unit area of the recording material P, and the unit is [g/m$^2$]. A driving signal generation unit 331 of a transmission control unit 33 generates a driving signal based on an instruction from the CPU 80 that is received via a communication unit 32. An amplifier unit 332 amplifies the driving signal generated by the driving signal generation unit 331, and outputs the amplified driving signal to the transmitting unit 31. With this, the transmitting unit 31 transmits an ultrasonic wave. The ultrasonic wave transmitted from the transmitting unit 31 is received by the receiving unit 71.

The receiving unit 71 outputs a voltage corresponding to the level of the received ultrasonic wave. An amplifier unit 342 of a reception control unit 34 amplifies the voltage input from the receiving unit 71, and outputs the amplified voltage to an A/D converter unit 343. The A/D converter unit 343 converts the voltage from the amplifier unit 342 to a digital signal. A peak detection unit 344 detects a peak value (maximum value) of values of the input digital signal, and saves the detected peak value in a storage unit 346. Note that the peak detection unit 344 saves the peak values in a state in which the recording material P is not present at a detection position 200 between the transmitting unit 31 and the receiving unit 71 and in a state in which the recording material P is present at the detection position 200 in the storage unit 346. Whether the recording material P is present or not is notified from the CPU 80 via the communication unit 32. A computation unit 345 calculates an attenuation coefficient from the ratio between the peak value in a state in which the recording material P is not present and the peak value in a state in which the recording material P is present, which are saved in the storage unit 346, and stores the attenuation coefficient into the storage unit 346. The attenuation coefficient indicates a degree of attenuation of an ultrasonic wave by the recording material P, and because the degree of attenuation differs depending on the basis weight, the basis weight of the recording material P can be determined from the attenuation coefficient. The CPU 80 acquires the attenuation coefficient from the storage unit 346 via the communication unit 32, and determines the basis weight of the recording material P. Also, the CPU 80 controls the image forming condition when an image is formed on a recording material P based on the determined basis weight of the recording material P. The image forming condition to be controlled includes a conveyance speed of the recording material P, a secondary transfer bias, a fixing temperature of the fixing device 21, and the like.

Figure 3:
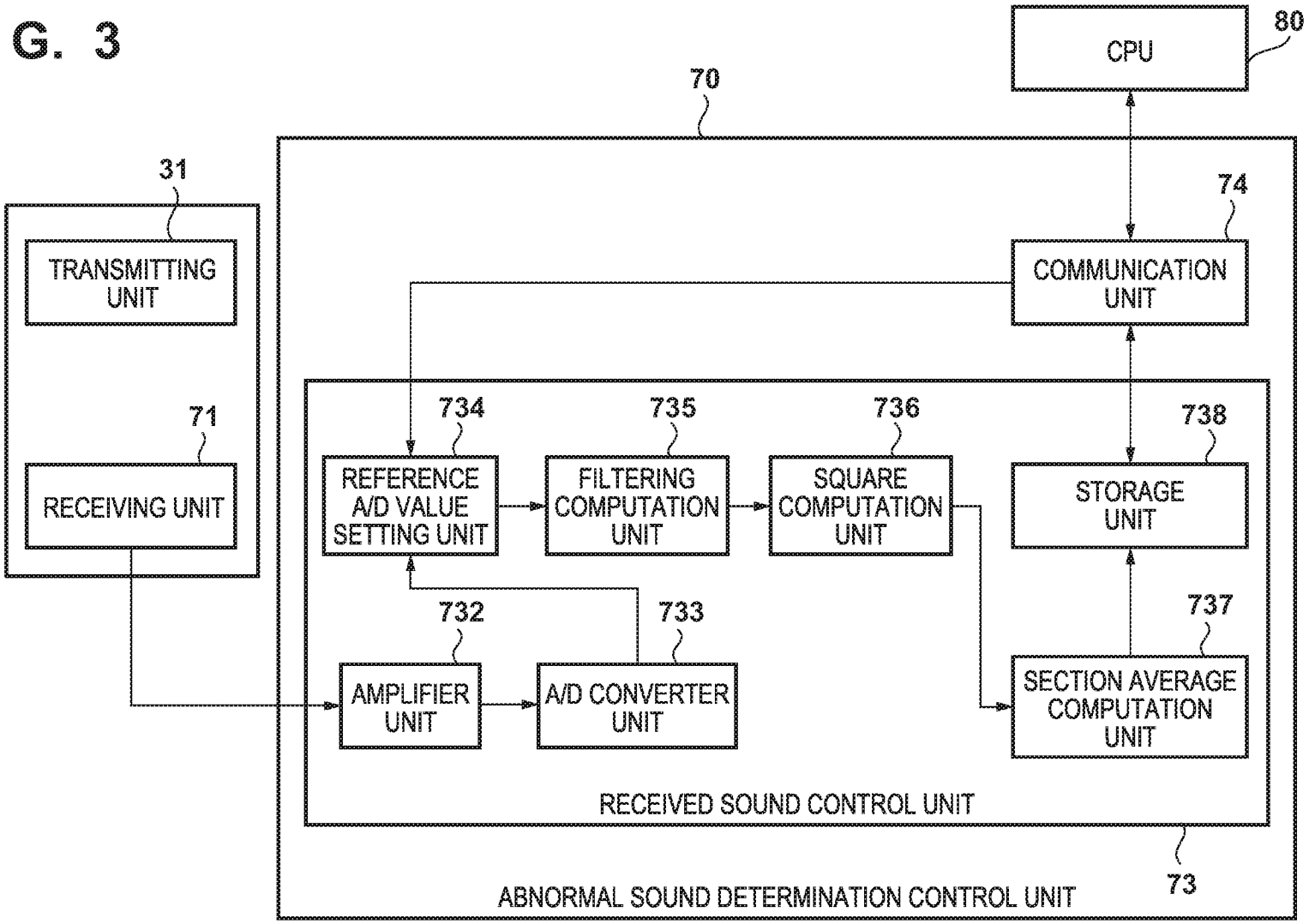
FIG. 3 is a block diagram of an abnormal sound determination control unit according to one embodiment.

FIG. 3 is a block diagram of the abnormal sound determination control unit 70. For example, the receiving unit 71, which is a MEMS microphone, outputs, when not only an ultrasonic wave but also a sonic wave in an audible range has been received, a voltage indicating the level of a received sonic wave, as described above. That is, the receivable range of the receiving unit 71 of the present embodiment includes an ultrasonic wave and a sonic wave in an audible range. Therefore, the receiving unit 71 can also detect an internal operating sound when the image forming apparatus 1 is operating. An amplifier unit 732 of a received sound control unit 73 amplifies the voltage indicating the level of a sonic wave that is output from the receiving unit 71, and an A/D converter unit 733 converts the voltage output from the amplifier unit 732 to a digital signal. The voltage output from the receiving unit 71 is a positive value, and therefore only a sound component due to pressure change needs to be extracted by removing a DC component. Therefore, a reference A/D value setting unit 734 extracts only a sound component due to pressure change by subtracting a reference value from values indicated by the digital signal that is input from the A/D converter unit 733. Note that the reference value is notified from the CPU 80 via the communication unit 74.

A filtering computation unit 735 performs filtering processing by applying a filter in order to extract a frequency component suitable for determining a specific sound (hereinafter, referred to as an "abnormal sound") from the digital signal from which a DC component has been removed by the reference A/D value setting unit 734. Note that the filtering computation unit 735 has a plurality of filters that are to be applied to a plurality of abnormal sounds to be determined, and performs filtering processing using the filter notified by the CPU 80. A square computation unit 736 performs a square computation on the digital signal subjected to the filtering processing, and a section average computation unit 737 performs a section average computation on the digital signal subjected to the square computation. For example, the time period for which a section average computation is performed is 100 ms. The time length for which the section average computation is performed may be the same regardless of the abnormal sound to be determined, or different in accordance with the abnormal sound to be determined. As a result of performing the square computation and the section average computation, the magnitude of a sound can be easily compared when an abnormal sound is determined. The section-averaged signal is stored in a storage unit 738 as a signal level L of the received sound. The CPU 80 acquires the signal level L from the storage unit 738 via the communication unit 74, and determines whether or not an abnormal sound is occurring. The CPU 80, upon determining that an abnormal sound is occurring, performs processing in accordance with the determined abnormal sound.

FIG. 4 shows determination information that is retained in the control unit 3 in advance. The CPU 80 determines an abnormal sound in accordance with the determination information. In the determination information shown in FIG. 4, abnormal sounds occurring in the feeding unit, a roller bearing of a roller of the roller unit, a roller contact of the roller of the roller unit, and the cleaning unit 36 are determination targets. In the following, the abnormal sounds are respectively referred to as a feeding unit abnormal sound, a roller bearing abnormal sound, a roller contact abnormal sound, and a cleaning unit abnormal sound. In the determination information, the sound collecting timing indicates a timing at which the abnormal sound is determined. For example, when the feeding unit abnormal sound is determined, the receiving result of the receiving unit 71 while the electromagnetic clutch for rotationally driving the feeding roller 4 is in an OFF state, and a recording material P is drawing out from the feeding unit by the conveyance roller pair 6 is used. Note that, when the electromagnetic clutch is in an OFF state, transmission of a driving force to the feeding roller 4 is cut off. Also, when the roller bearing abnormal sound, the roller contact abnormal sound, and the cleaning unit abnormal sound are determined, the receiving result of the receiving unit 71 before a recording material P is fed to the conveyance path or while a recording material P temporarily stops after the recording material P has been fed is used. That is, in this example, when the roller bearing abnormal sound, the roller contact abnormal sound, and the cleaning unit abnormal sound are determined, the receiving result of the receiving unit 71 while, although rollers are rotating, a recording material P is not being conveyed in the conveyance path is used. Note that, as shown in FIG. 4, if the conveyance sound of a recording material P after passing a position opposing the receiving unit 71 decreases below the abnormal sound to be determined by a predetermined value or more, the receiving result after the tail end of the recording material P has passed the position opposing the receiving unit 71 can be used. In this manner, the determination information indicates a correspondence relationship between the abnormal sounds of determination targets (or members causing abnormal sounds) and the operating states of the image forming apparatus. Also, the CPU 80 determines whether the abnormal sound of a determination target is occurring based on the receiving result of the receiving unit 71 when the image forming apparatus is in an operating state corresponding to the abnormal sound of the determination target. Note that, in order to accurately determine an abnormal sound, the CPU 80 stops transmission of an ultrasonic wave from the transmitting unit 31 while the receiving unit 71 is collecting sounds for determining the abnormal sound.

Also, the abnormal sounds shown in FIG. 4 are examples, and an abnormal sound from any member can be a determination target. For example, abnormal sounds from the photoconductive member 11 and other rollers such as the driving roller 18 can be determination targets. A configuration can be adopted in which a roller bearing abnormal sound and a roller contact abnormal sound are separately determined with respect to the abnormal sounds from other rollers. Note that the sound collecting timing can be, similarly to the roller bearing abnormal sound and the roller contact abnormal sound shown in FIG. 4, in a period while a recording material P is not conveyed in the conveyance path or in a period while the conveyance sound of a recording material P is smaller than the abnormal sound of a determination target by a predetermined value or more.

Also, the determination information also indicates a filter to be used by the filtering computation unit 735 in order to determine the abnormal sound of a determination target. In the example in FIG. 4, a filter is specified by its pass band. For example, when the feeding unit abnormal sound and the cleaning unit abnormal sound are determined, the filtering computation unit 735 uses a low pass filter whose pass band is 500 Hz or less. Also, when the roller bearing abnormal sound and the roller contact abnormal sound are determined, the filtering computation unit 735 uses a bandpass filter whose pass band is from 5 kHz to 10 kHz. Moreover, the determination information shows, for each determination target, a criterion of the abnormal sound, a number of determinations Nth, and a number of releases Mth. Note that the meanings of these values will be described in a later-described abnormal sound determination processing. Also, the "processing details when an anomaly is determined" in the table shown in FIG. 4 shows processing to be performed by the CPU 80 when it is determined that the corresponding abnormal sound is occurring.

Figure 5:
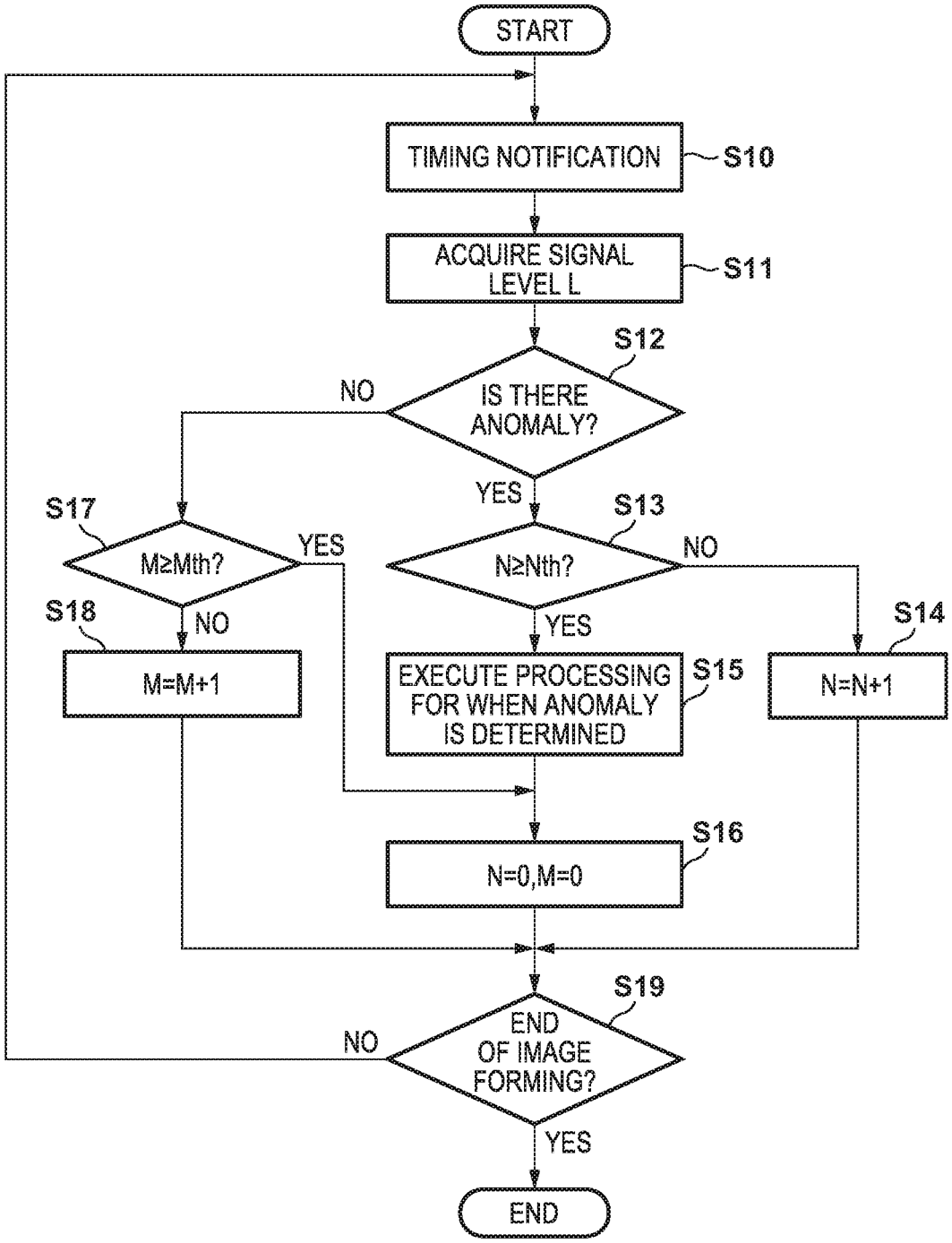
FIG. 5 is a flowchart of abnormal sound determination processing according to one embodiment.

FIG. 5 is a flowchart of the abnormal sound determination processing according to the present embodiment. In step S10, the CPU 80 selects an abnormal sound to be determined, and notifies the abnormal sound determination control unit 70 of the receiving timing (period) of the receiving unit 71 for determining the selected abnormal sound. Note that, in step S10, the CPU 80 also notifies the abnormal sound determination control unit 70 of the filter to be used to determine the selected abnormal sound, the reference value to be used by the reference A/D value setting unit 734, and the like. With this, the abnormal sound determination control unit 70 obtains a signal level L at the notified receiving timing, and stores the signal level L into the storage unit 738. In step S11, the CPU 80 acquires the signal level L from the storage unit 738.

In step S12, the CPU 80 determines whether or not the signal level L is anomalous based on the criterion shown in FIG. 4. For example, in FIG. 4, the criterion of the feeding unit abnormal sound is that the signal level L is larger than 41 dB. Therefore, if the signal level L acquired in step S11 is larger than 41 dB, "Yes" is determined in step S12, and if the signal level L acquired in step S11 is 41 dB or less, "No" is determined in step S12. When the roller bearing abnormal sound and the cleaning unit abnormal sound are determined, whether or not the signal level L is anomalous is determined by comparing the signal level L with a threshold value. On the other hand, when the roller contact abnormal sound is determined, whether or not the change in signal level L over time has periodicity is determined in addition to the comparison between the signal level L and a threshold value. That is, if the signal level L is larger than 23 dB, which is the threshold value, and increases and decreases at a predetermined period, "Yes" is determined in step S12, and in other cases, "No" is determined in step S12.

If it is determined that the signal level L is anomalous in step S12, the CPU 80 determines whether a counter N is a threshold value Nth or more in step S13. The threshold value Nth is shown in the "number of determinations" in FIG. 4. If the counter N is not the threshold value Nth or more, in step S14, the CPU 80 increments the counter N by one and advances the processing to step S19. On the other hand, if the counter N is the threshold value Nth or more, the CPU 80 determines that an abnormal sound of the determination target is occurring, and executes processing corresponding to the anomaly determined to be occurring, in step S15. The processing to be performed in step S15 is shown in the "processing details when the anomaly is determined" in FIG. 4. Thereafter, in step S16, the CPU 80 initializes the counters N and M to 0, and advances the processing to step S19.

On the other hand, if it is determined that the signal level L is not anomalous in step S12, the CPU 80 determines, in step S17, whether the counter M is a threshold value Mth or more. The threshold value Mth is shown in the "number of releases" in FIG. 4. If the counter M is not the threshold value Mth or more, in step S18, the CPU 80 increments the counter M by one and advances the processing to step S19. On the other hand, if the counter M is the threshold value Mth or more, in step S16, the CPU 80 initializes the counters N and M to 0, and advances the processing to step S19.

In step S19, the CPU 80 determines whether the image formation has ended, and if the image formation has not ended, repeats the processing from step S10. On the other hand, if the image formation has ended, the CPU 80 ends the processing in FIG. 5. Note that the counter N is not initialized to 0 when the image formation has ended, and retains its value. That is, the counter N is initialized to 0 only in step S16. Note that the counter M may be configured to be initialized to 0 when the image formation has ended, or may be configured to be initialized to 0 only in step S16, similarly to the counter N.

Note that, a configuration may be adopted in which the CPU 80 normally selects the abnormal sound to be determined successively from the table in FIG. 4 downward from the first row, and when "Yes" is determined in step S12, selects the abnormal sound, which is selected at this time, a plurality of times continuously, and determines whether or not the abnormal sound is occurring, for example. Also, the configuration may also be such that the CPU 80 determines the degrees of deterioration of replacement components based on the time period elapsed since the start of usage of each replacement component, selects frequently the abnormal sound from the replacement component whose degree of deterioration is high, and determines whether or not the abnormal sound is occurring.

Figure 6:
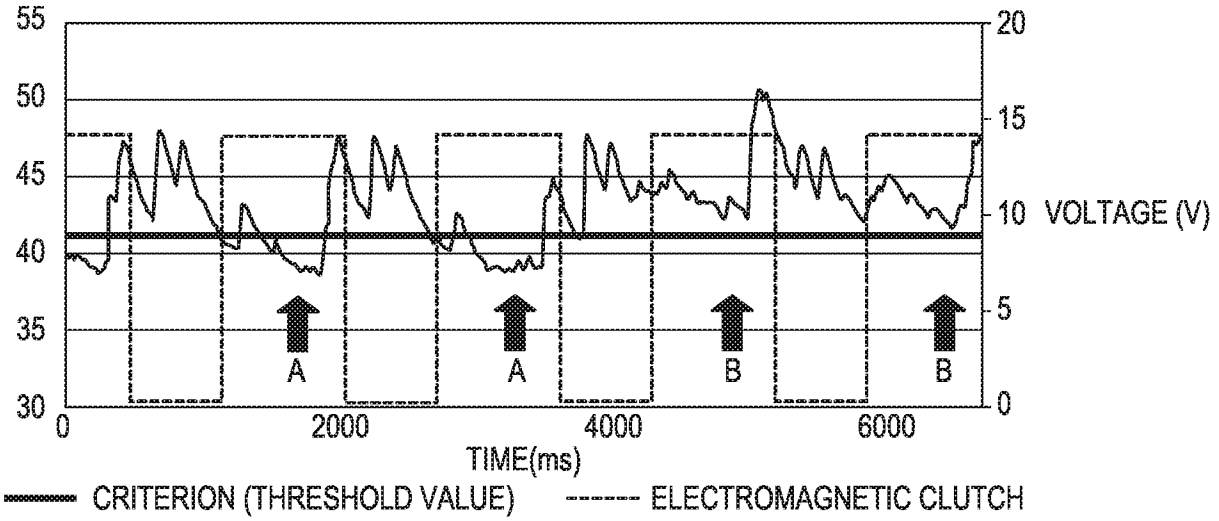
FIG. 6 is a diagram illustrating an example of a signal level when an abnormal sound of a feeding unit is determined.

FIG. 6 shows the signal level L of a sound from the feeding unit. The dotted line in FIG. 6 shows the state of the electromagnetic clutch, and when the voltage of the electromagnetic clutch (vertical axis on the right side in FIG. 6)

is 0 V, the electromagnetic clutch is in an ON state, and when the voltage is 14 V, the electromagnetic clutch is in an OFF state. When the electromagnetic clutch is turned on, a recording material P is fed. Therefore, FIG. 6 shows the signal level L while four recording materials P are being fed. Also, the thick line in the graph in FIG. 6 indicates 41 dB, which is a threshold value.

The feeding unit abnormal sound occurs because the surfaces of the feeding roller 4 and the separation roller 5 are worn away due to the feeding of the recording materials P. When a recording material P is drawn out by the downstream conveyance roller pair 6 in a state in which the electromagnetic clutch is turned off and the rotational driving of the feeding roller 4 is stopped, a vibration may occur in the separation roller 5 that rotates due to drawing out of the recording material P. This vibration causes vibration in the separation roller 5 and the recording material P, and as a result, an abnormal sound is generated. Therefore, the generation of the feeding unit abnormal sound is determined based on the sound received by the receiving unit 71 in a period in which the electromagnetic clutch is in an OFF state, and a recording material P is being drawn out from the feeding unit by the conveyance roller pair 6. The arrows A in FIG. 6 indicate timings at which the signal level L is a threshold value or less, and the arrows B indicate timings at which the signal level L is larger than the threshold value. From the determination information in FIG. 4, if it has been determined that the signal level L is larger than the threshold value three times, the CPU 80 determines that the feeding unit abnormal sound is occurring. In this case, as shown in FIG. 4, the CPU 80 performs control so as to reduce the generation of the abnormal sound, specifically, to reduce the time period in which the abnormal sound occurs, by extending the time period in which the electromagnetic clutch is in an ON state. Also, as shown in FIG. 4, the CPU 80 performs control to notify a user by displaying a message for prompting the user to replace the feeding unit in an unshown display unit, or reports the state to a service center or the like via a network.

Figure 7:
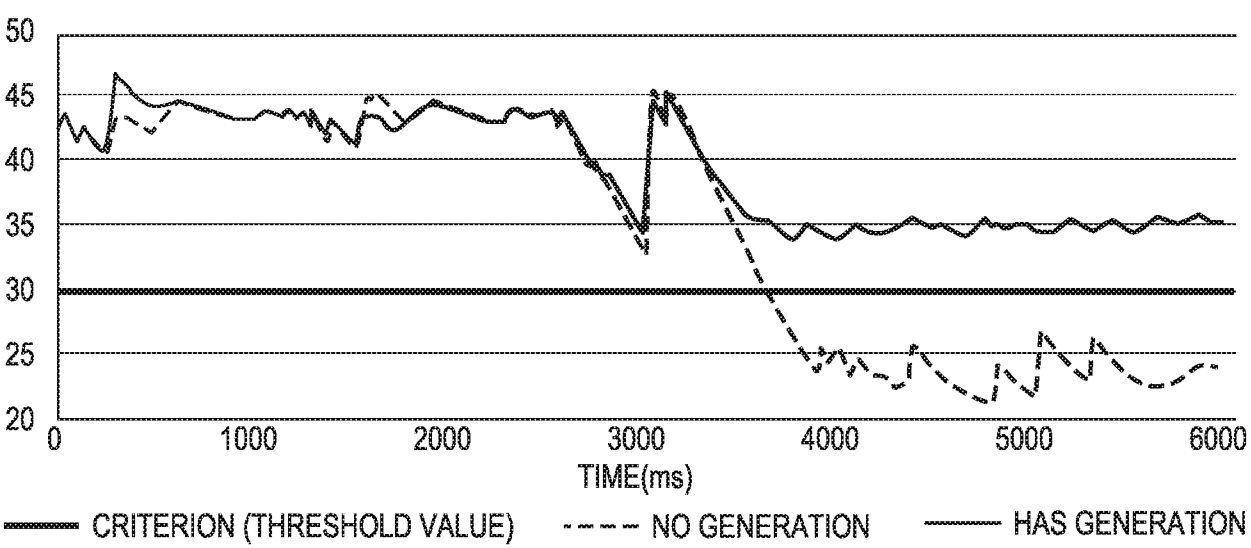
FIG. 7 is a diagram illustrating an example of a signal level when an abnormal sound of a roller bearing is determined.

FIG. 7 shows the signal level L of a sound from the roller unit when the roller bearing abnormal sound is determined. The roller bearing abnormal sound is generated due to a bearing being ground as a result of the bearing and a roller sliding against one another. In this example, while a recording material P is being conveyed, the conveyance sound is loud, and the roller bearing abnormal sound is not discernible. Therefore, the generation of the roller bearing abnormal sound is determined based on a receiving result in a period in which a recording material P is not present in the conveyance path, or a recording material P temporarily stops after the recording material P has been fed. Note that FIG. 7 shows the signal level L of a sound measured before and after a recording material P is discharged from the conveyance path, and the recording material P is discharged at a point in time of about 3800 ms. Note that after the recording material P is discharged, the roller of the roller unit is still rotating. In the graph in FIG. 7, the solid line indicates the signal level L when an abnormal sound is generated, and the dotted line indicates the signal level L when an abnormal sound is not generated. Note that the thick line in FIG. 7 indicates 30 dB, which is a threshold value. Note that, as described above, even if a recording material P is being conveyed, if the conveyance sound is less than the level of the abnormal sound to be determined by a predetermined value or more, the abnormal sound can be determined based on the receiving result of the receiving unit 71 in this period. For example, the abnormal sound can be determined based on the receiving result of the receiving unit 71 after the tail end of a recording material P has passed through a position opposing the receiving unit 71.

Figure 8:
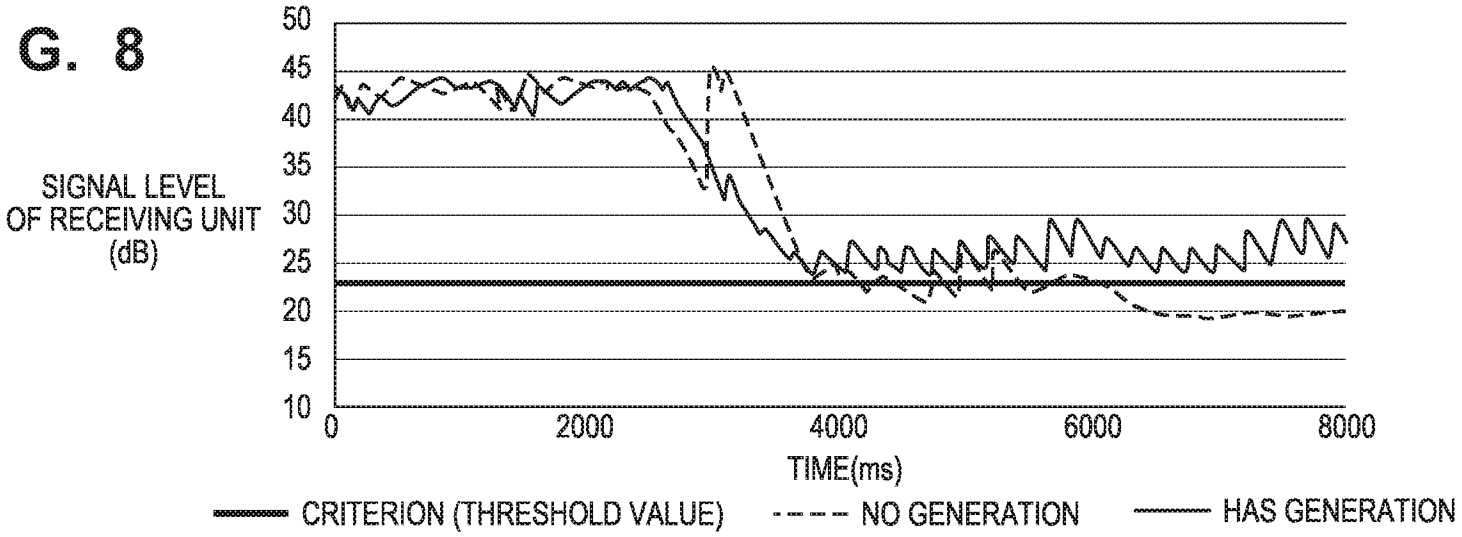
FIG. 8 is a diagram illustrating an example of a signal level when an abnormal sound of a roller contact is determined.

FIG. 8 shows the signal level L of a sound from the roller unit when the roller contact abnormal sound is determined. Note that the roller contact is an earth contact for preventing a roller having a metal shaft from being charged. The roller contact abnormal sound is generated as a result of a wire spring being worn away at a contact portion between the roller shaft and the metal wire spring. The roller contact abnormal sound is also determined, similarly to the roller bearing abnormal sound, based on the receiving result of the receiving unit 71 in a period in which the conveyance sound of a recording material P does not occur, or the conveyance sound of a recording material P is smaller than the roller bearing abnormal sound by a predetermined value or more. Note that FIG. 8 shows the signal level L of a sound collected before and after a recording material P is discharged from the conveyance path, and the recording material P is discharged at a point in time of about 4000 ms. In the graph in FIG. 8, the solid line indicates the signal level L when the abnormal sound is generated, and the dotted line indicates the signal level L when the abnormal sound is not generated. Note that the thick line in FIG. 8 indicates 23 dB, which is a threshold value. Also, as shown in FIG. 8, the roller contact abnormal sound, which is also called "roller contact squeaking sound" occurs periodically. Therefore, as shown in FIG. 4, the periodicity of the signal level L is also used to determine the generation of the abnormal sound.

Figure 9:
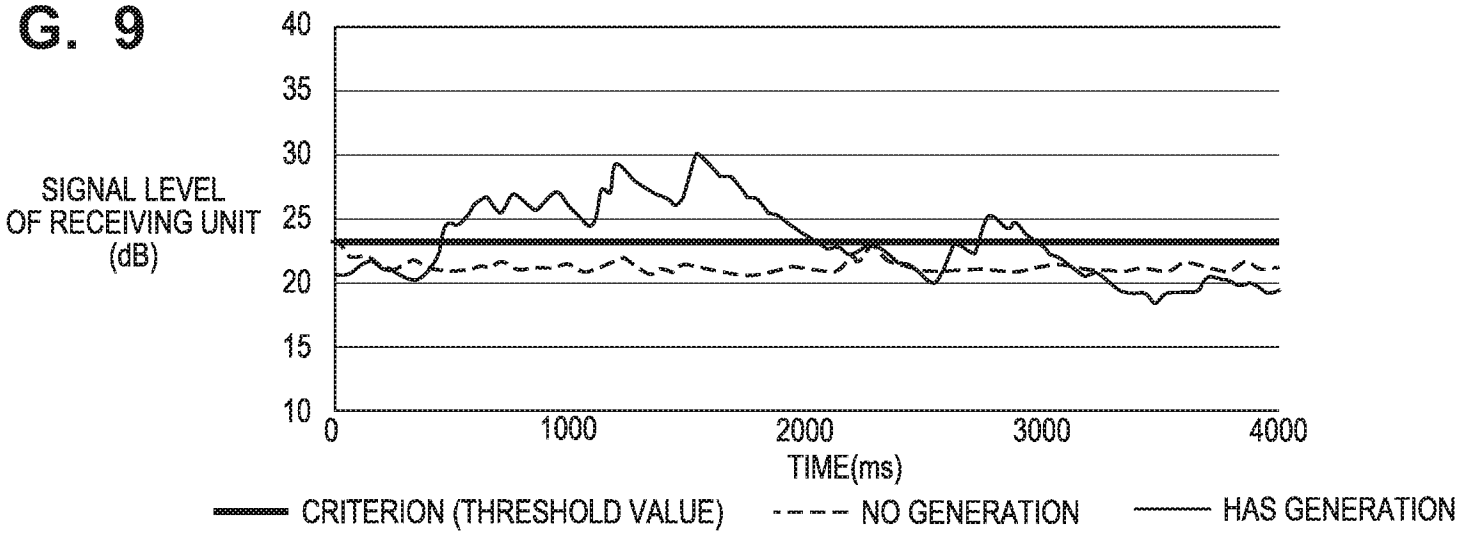
FIG. 9 is a diagram illustrating an example of a signal level when an abnormal sound of a cleaning unit is determined.

FIG. 9 shows the signal level L of a sound from the cleaning unit. When the intermediate transfer belt 17 is worn out and its surface property has changed, the sliding resistance between the cleaning blade 35 of the cleaning unit 36 and the intermediate transfer belt 17 changes, and as a result an abnormal sound from the cleaning unit 36 occurs. This abnormal sound is also not discernible if the conveyance sound of a recording material P is present. Therefore, the acquisition timing of the sound is in a period in which the conveyance sound of a recording material P is not occurring, or in a period in which the conveyance sound of a recording material P is smaller than the abnormal sound by a predetermined value or more. Note that FIG. 9 shows the signal level L of a sound collected before a recording material P is being fed. In the graph in FIG. 9, the solid line indicates the signal level L when the abnormal sound is occurring, and the dotted line indicates the signal level L when the abnormal sound is not occurring. Note that the thick line in FIG. 9 indicates 23 dB, which is a threshold value.

As described above, the states of members of the image forming apparatus 1 are determined by utilizing the receiving unit 71 that is used to detect the basis weight of a recording material P. Specifically, it is determined whether or not a member is generating an abnormal sound while being in operation. As a result of determining an abnormal sound using the receiving unit 71 for basis weight detection that is generally provided in an image forming apparatus, the number of components to be added for determining an abnormal sound can be reduced, and the cost of the image forming apparatus 1 can be reduced. Also, the size of the image forming apparatus 1 can be reduced.

Note that, in FIG. 1, the transmitting unit 31 and the receiving unit 71 are arranged between the conveyance roller pair 6 and the secondary transfer roller 19, in the conveyance direction of the recording material P, but the transmitting unit 31 and the receiving unit 71 can also be arranged between the feeding roller 4 and the conveyance roller pair 6. As a result of arranging the receiving unit 71 close to the feeding unit, the accuracy of detecting the abnormal sound of the feeding unit can be improved.

Also, in the present embodiment, the CPU 80 selects the determination target abnormal sound. However, the configuration may be such that, instead of setting a specific abnormal sound as the determination target, the receiving unit 71 continuously collects sounds, and the CPU 80 determines the occurrences of the abnormal sounds and the positions at which the abnormal sounds are occurring by performing computations in accordance with the respective determination target abnormal sounds on the receiving result of the receiving unit 71. Moreover, in the present embodiment, an abnormal sound is detected by utilizing the receiving unit 71 that is used to detect the basis weight, which is a parameter for specifying the type of a recording material P. However, a configuration may also be adopted in which an abnormal sound is detected by utilizing a receiving unit 71 that is used to detect another parameter for specifying the type of a recording material P, e.g., the thickness. More generally, the configuration may be such that an abnormal sound is detected by utilizing a receiving unit 71 that receives sounds for detecting the type of a recording material P.

Also, the threshold values for the respective determination target abnormal sounds can be determined in advance. Moreover, the configuration can also be such that the receiving unit 71 is caused to receive sonic waves in an initial stage of the operation of the image forming apparatus, and the threshold values are determined based on the received result.

Second Embodiment

Next, a second embodiment will be described focusing on the difference from the first embodiment. If a driving unit including motors for driving rollers is used over its lifetime in an image forming apparatus, a problem may occur such as an image failure due to grinding of gears, depletion of grease, or the like in the driving unit. In this case, the driving unit needs to be replaced. In the present embodiment, the driving unit that is used over its lifetime is determined by a sonic wave occurring in the driving unit.

When grinding of gears, depletion of grease, or the like occurs in the driving unit, the sound from the driving unit gradually increases such that a user does not feel the sound as an uncomfortable abnormal sound. In the present embodiment, the number of recording materials P on which images are formed is stored in an unshown storage unit in the control unit 3. If the number of recording materials P stored in the storage unit reaches a predetermined number, e.g., 10000, the control unit 3 independently drives each driving unit. In this example, the image forming apparatus is assumed to include a feeding driving unit for driving the feeding roller 4 and the like, an image forming driving unit for driving an image formation unit, and a fixing driving unit that drives the fixing device 21 and the like. Note that the image formation unit includes at least one of the photoconductive member 11, the charging roller 12, the developing device 14, the intermediate transfer belt 17, and the cleaning unit 36. In this case, the control unit 3 successively drives the feeding driving unit, the image forming driving unit, and the fixing driving unit. That is, the control unit 3 performs control such that two or more of the driving units of the three driving units are not driven at the same time. Then, the abnormal sound determination control unit 70 stores the signal level L of a received sound that is created based on sonic waves received by the receiving unit 71 in a state in which only one driving unit is being driven, similarly to the first embodiment.

Figure 10:
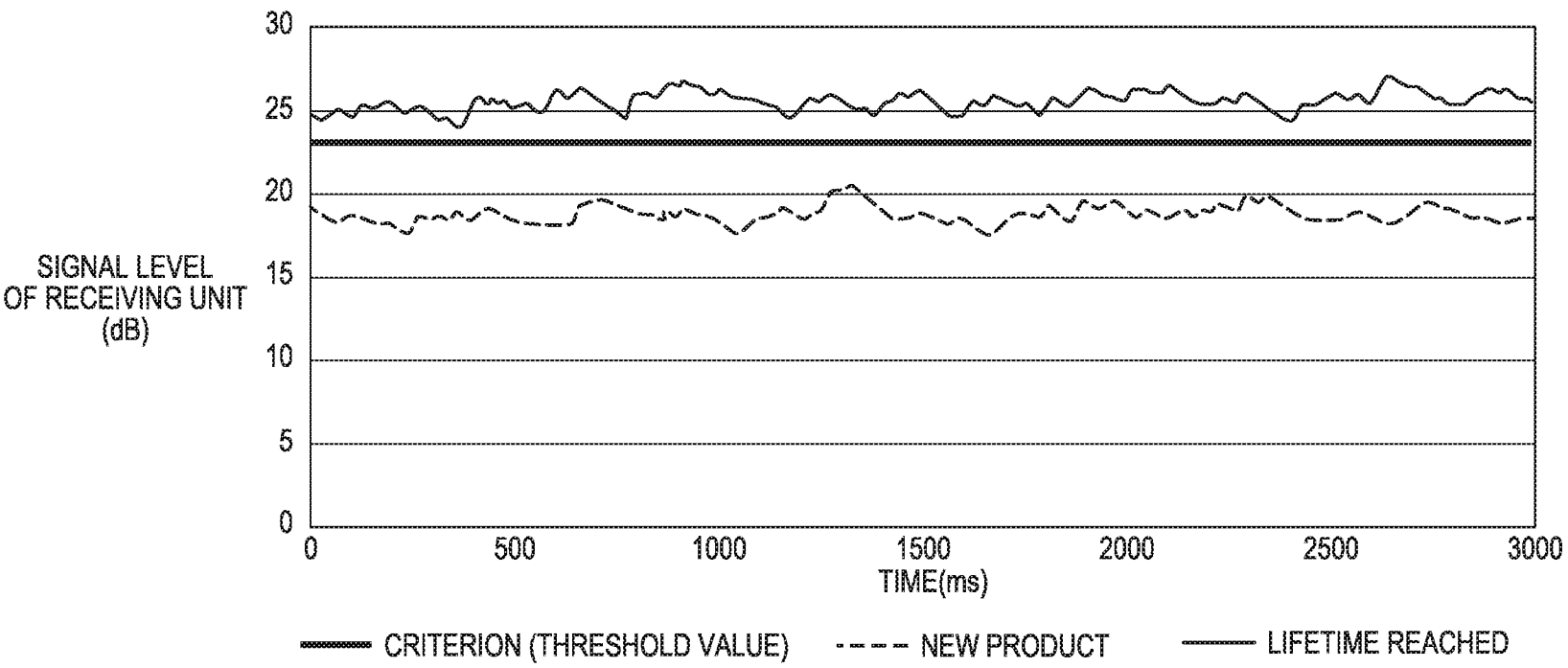
FIG. 10 is a diagram illustrating an example of a signal level when the replacement timing of a feeding driving unit is determined.

FIG. 10 shows the signal level L of a sound from the feeding driving unit. The dotted line in the diagram indicates the signal level L of the feeding driving unit when the feeding driving unit has started to be used, and the solid line indicates the signal level L of the feeding driving unit when the feeding driving unit has reached its lifetime. The criterion for determining the replacement timing of the feeding driving unit is set to 23 dB indicated by the thick line. As shown in FIG. 10, because the signal level L of the feeding driving unit that has reached its lifetime continuously exceeds 23 dB, which is the criterion, it can be determined that replacement is needed. The control unit 3, upon determining that it is a replacement timing of the feeding driving unit, performs control to notify a user by displaying a message in an unshown display unit, or reports that replacement is needed to a service center or the like via a network.

As described above, the states of the members of the image forming apparatus 1 are determined utilizing the receiving unit 71 that is used to detect the basis weight of a recording material P. Specifically, it is determined whether or not a member has reached a predetermined lifetime. With this, similarly to the first embodiment, the number of components to be added for determining the states of the members can be reduced, and the cost of the image forming apparatus 1 can be reduced. Also, the size of the image forming apparatus 1 can be reduced.

Third Embodiment

Next, a third embodiment will be described focusing on the difference from the first embodiment. As described above, when a recording material P is fed to the conveyance path, the recording materials P are separated sheet by sheet by the separation roller 5. However, so-called double feed, which is a phenomenon in which the separation roller 5 does not function and a plurality of recording materials P are fed in an overlaid state, may occur when sheets are conveyed. Therefore, the image forming apparatus 1 is provided with a function of detecting the double feed. In the present embodiment, the occurrence of an abnormal sound is determined utilizing a receiving unit used for detecting this double feed.

Figure 11:
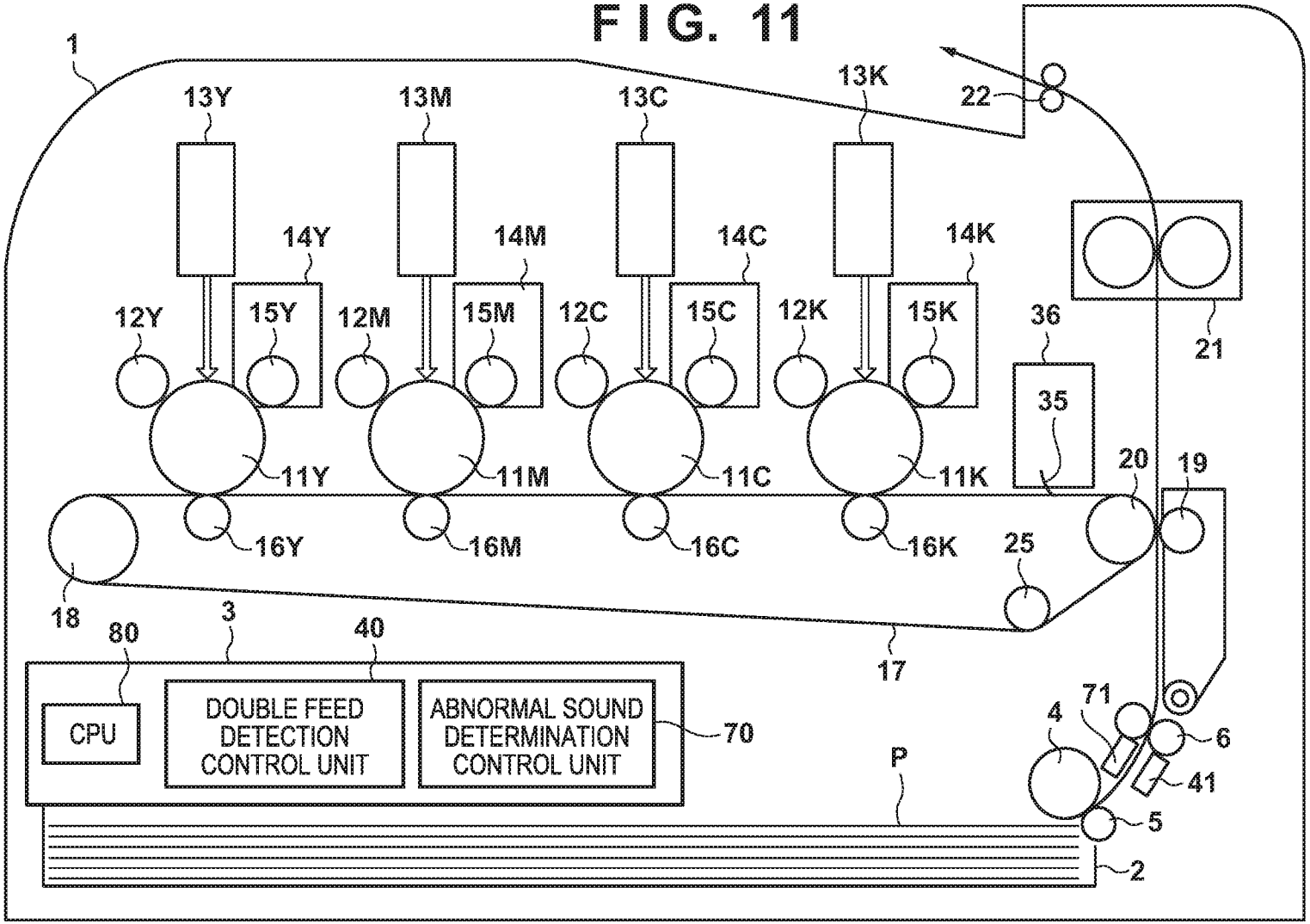
FIG. 11 is a configuration diagram of an image forming apparatus according to one embodiment.

FIG. 11 is a configuration diagram of an image forming apparatus according to the present embodiment. Note that the constituent elements similar to those of the image forming apparatus in FIG. 1 are given the same reference signs, and the description thereof will be basically omitted. A transmitting unit 41 transmits an ultrasonic wave. A receiving unit 71 is similar to that in the first embodiment. Note that the transmitting unit 41 and the receiving unit 71 are respectively arranged on sides opposite to each other relative to the conveyance path. In the present embodiment, the transmitting unit 41 and the receiving unit 71 are provided between a feeding roller 4 and a conveyance roller pair 6 in a conveyance direction of the recording material P. Also, the control unit 3 includes a double feed detection control unit 40.

Figure 12:
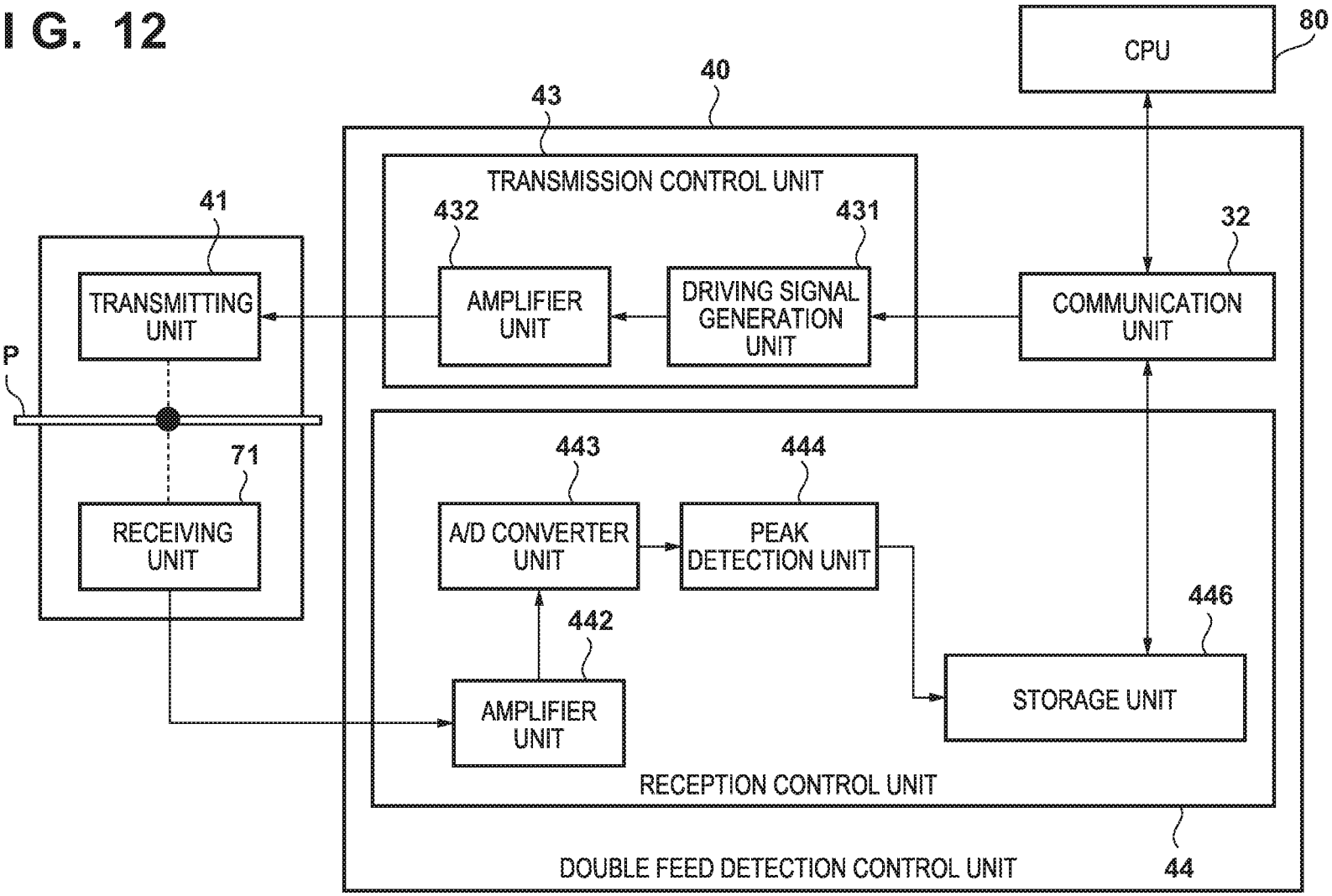
FIG. 12 is a block diagram of a double feed detection control unit according to one embodiment.

FIG. 12 is a block diagram of the double feed detection control unit 40. A driving signal generation unit 431 of a transmission control unit 43 generates a driving signal based on an instruction from a CPU 80 that is received via a communication unit 32. An amplifier unit 432 amplifies the driving signal generated by the driving signal generation unit 431, and outputs the amplified driving signal to the transmitting unit 41. With this, the transmitting unit 41 transmits an ultrasonic wave. The ultrasonic wave transmitted from the transmitting unit 41 is received by the receiving unit 71.

The receiving unit 71 outputs a voltage corresponding to the level of the ultrasonic wave received through a recording material P. An amplifier unit 442 of a reception control unit 44 amplifies a voltage input from the receiving unit 71, and outputs the amplified voltage to an A/D converter unit 443. The A/D converter unit 443 converts the voltage from the amplifier unit 442 to a digital signal, and outputs the digital signal to a peak detection unit 444. The peak detection unit 444 detects a peak value (maximum value) of values of the input digital signal, and saves the detected peak value in a storage unit 446. The CPU 80 acquires a peak value from the storage unit 446 via the communication unit 32, and compares the peak value with a reference peak value. The reference peak value is a peak value when there is one recording material P, and is measured and stored in the control unit 3 in advance. When the double feed is not occurring, the difference between the peak value acquired from the storage unit 446 and the reference peak value is small. On the other hand, if the double feed is occurring, the level of ultrasonic wave received by the receiving unit 71 decreases. Therefore, when the double feed is occurring, the difference between the peak value acquired from the storage unit 446 and the reference peak value is large. Therefore, the CPU 80 can determine whether or not the double feed is occurring based on whether or not the difference between the peak value acquired from the storage unit 446 and the reference peak value is larger than a threshold value.

Note that the method of determining a specific sound utilizing the receiving unit 71 is similar to those of the first and second embodiments, and therefore the description thereof will be omitted.

As described above, as a result of determining the states of the members utilizing the receiving unit 71 that is used to detect the double feed, which is a state of the recording materials P, the number of components can be reduced, and the reduction in size of the image forming apparatus can be realized. As a result, the cost of the image forming apparatus 1 can be reduced.

Fourth Embodiment

In the first embodiment, the basis weight detection control unit 30 is provided with the amplifier unit 342 and the A/D converter unit 343, and the abnormal sound determination control unit 70 is provided with the amplifier unit 732 and the A/D converter unit 733. In the present embodiment, an amplifier unit and an A/D converter unit are shared between the control units.

Figure 13:
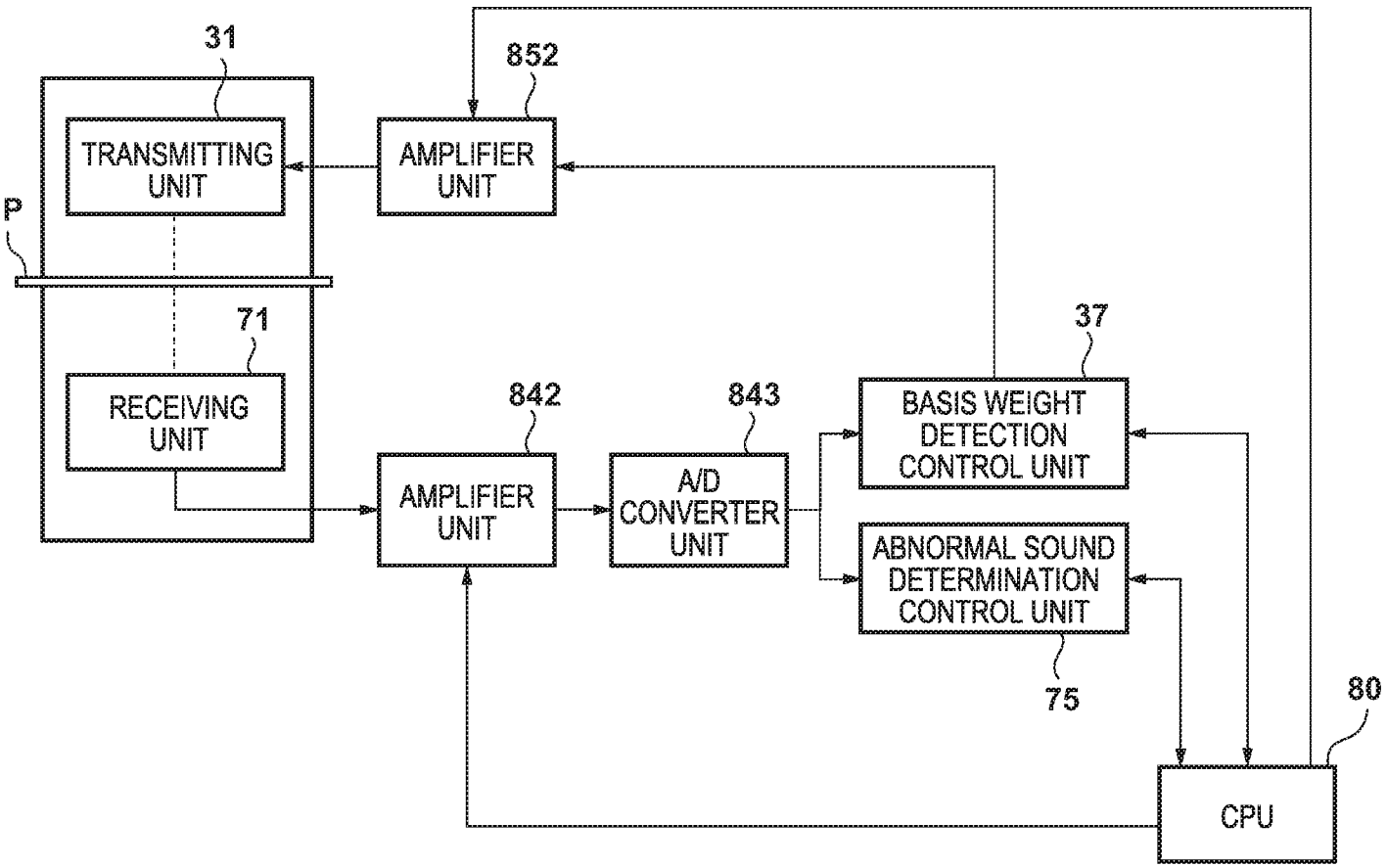
FIG. 13 is a diagram illustrating a configuration relating to basis weight detection and abnormal sound determination according to one embodiment.

FIG. 13 is a control configuration diagram relating to basis weight detection and abnormal sound determination according to the present embodiment. A basis weight detection control unit 37 is equivalent to the basis weight detection control unit 30 in FIG. 2 from which the amplifier units 332 and 342 and the A/D converter unit 343 are removed. Note that an amplifier unit 852 is provided in FIG. 13 in place of the amplifier unit 332 in FIG. 2. Also, an amplifier unit 842 and an A/D converter unit 843 are provided in FIG. 13 in place of the amplifier unit 342 and the A/D converter unit 343 in FIG. 2. Also, an abnormal sound determination control unit 75 is equivalent to the abnormal sound determination control unit 70 in FIG. 3 from which the amplifier unit 732 and the A/D converter unit 733 are removed. Note that the amplifier unit 842 and the A/D converter unit 843 are provided in FIG. 13 in place of the amplifier unit 732 and the A/D converter unit 733 in FIG. 3. That is, the amplifier unit 842 and the A/D converter unit 843 in the present embodiment are respectively obtained by commonizing the amplifier unit 342 and the amplifier unit 732 in the first embodiment and commonizing the A/D converter unit 343 and the A/D converter unit 733 in the first embodiment. The A/D converter unit 843 is configured to be able to output a digital signal to both of the basis weight detection control unit 37 and the abnormal sound determination control unit 75.

When the basis weight is detected, the CPU 80 instructs the basis weight detection control unit 37 to transmit an ultrasonic wave. With this, the basis weight detection control unit 37 outputs a driving signal. The amplifier unit 852 amplifies the driving signal, and outputs the amplified driving signal to the transmitting unit 31. Note that the amplification factor of the amplifier unit 852 is set by the CPU 80. Also, when the basis weight is detected, the CPU 80 sets a preset first amplification factor suitable for detecting the basis weight to the amplifier unit 842. The A/D converter unit 843 digitally converts the voltage from the amplifier unit 842 that has been amplified with the first amplification factor, and outputs the digitally converted voltage to the basis weight detection control unit 37. The processing in the basis weight detection control unit 37 thereafter is similar to that in the first embodiment.

When an abnormal sound is determined, the CPU 80 sets a preset second amplification factor suitable for determining the abnormal sound to the amplifier unit 842. Note that, because the level of the abnormal sound is larger than that of the ultrasonic wave, the second amplification factor is smaller than the first amplification factor. The A/D converter unit 843 digitally converts the voltage from the amplifier unit 842 that has been amplified with the second amplification factor, and outputs the digitally converted voltage to the abnormal sound determination control unit 75. The processing in the abnormal sound determination control unit 75 thereafter is similar to that in the first embodiment. Note that a configuration can be adopted in which the digital signal from the A/D converter unit 843 is constantly output to both of the basis weight detection control unit 37 and the abnormal sound determination control unit 75. Also, the configuration can be such that the digital signal from the A/D converter unit 843 is output to only one of the basis weight detection control unit 37 and the abnormal sound determination control unit 75 in accordance with whether the basis weight detection is to be performed or the determination of an abnormal sound is to be performed.

Figure 14:
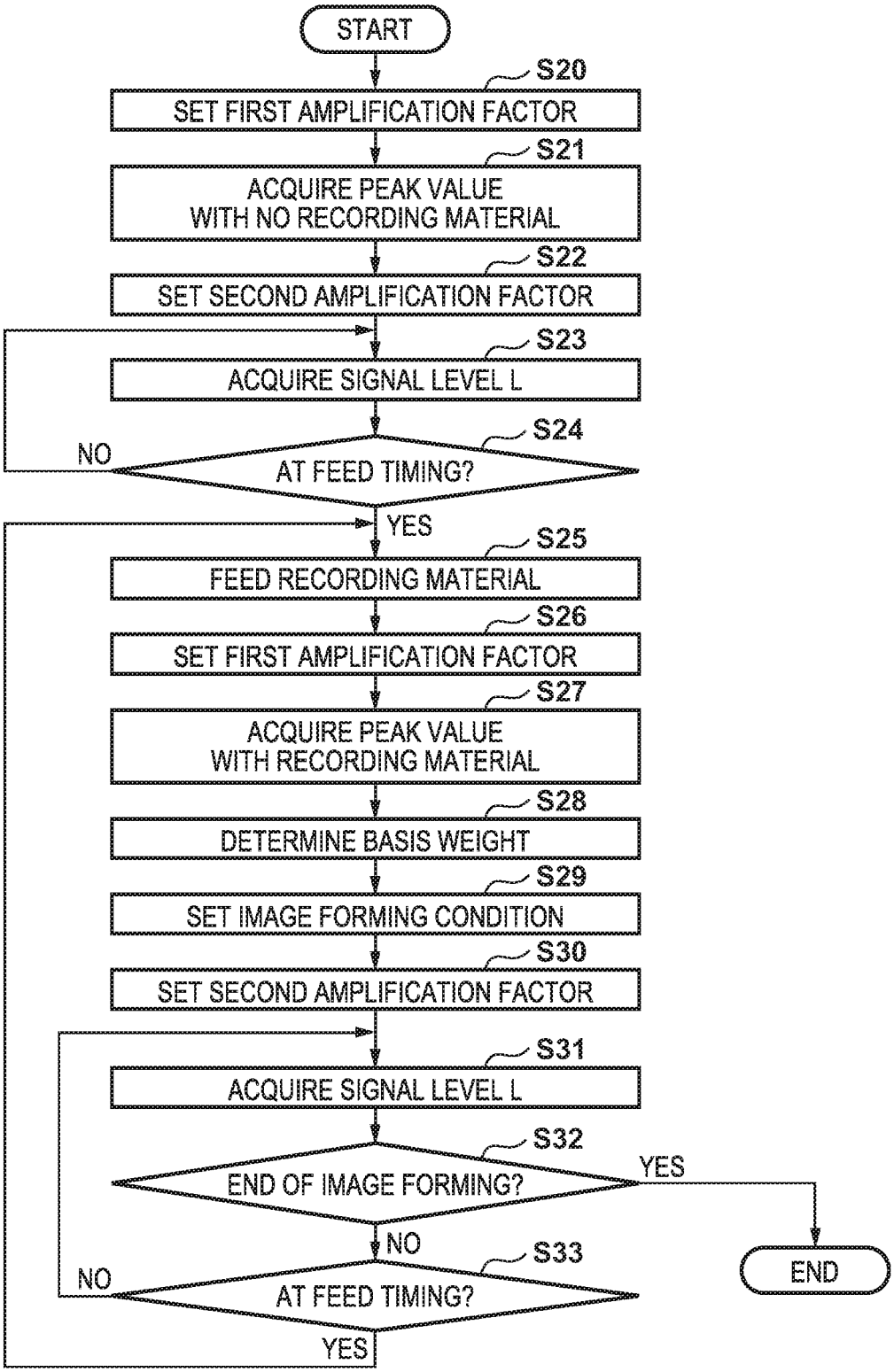
FIG. 14 is a flowchart of processing relating to the basis weight detection and the abnormal sound determination according to one embodiment.

FIG. 14 is a flowchart of processing to be executed when the CPU 80 performs image formation in the present embodiment. When the image formation is started, in step S20, the CPU 80 sets the first amplification factor to the amplifier unit 842 for detecting the basis weight. Also, in step S21, the CPU 80 causes basis weight detection control unit 37 to acquire a peak value in a state in which a recording material P is not present in a detection position 200. Upon the acquisition of the peak value by the basis weight detection control unit 37 being completed, in step S22, the CPU 80 sets the second amplification factor to the amplifier unit 842 for determining an abnormal sound, and in step S23, determines the abnormal sound by causing the abnormal sound determination control unit 75 to acquire the signal level L. In step S24, the CPU 80 determines whether the current time is a feed timing of a recording material P, and continues the processing in step S23 until the feed timing of the recording material P. In step S24, upon arrival of the feed timing of the recording material P, the CPU 80 feeds the recording material P in step S25. Thereafter, in step S26 that is executed at a predetermined timing before the recording material P reaches the detection position 200, the CPU 80 sets the first amplification factor to the amplifier unit 842 for detecting the basis weight. Note that, although not being described in FIG. 14, the CPU 80 can continue the acquisition of the signal level L and the determination of the abnormal sound until the first amplification factor is set to the amplifier unit 842 in step S26. Also, in step S27, the CPU 80 causes the basis weight detection control unit 37 to acquire a peak value in a state in which the recording material P is present at the detection position 200.

In step S28, the CPU 80 determines the basis weight of the recording material P based on the ratio of the peak value in a state in which the recording material P is not present at the detection position 200 and the peak value in a state in which the recording material P is present at the detection position 200. In step S29, the CPU 80 sets the image forming condition based on the determined basis weight. Thereafter, the CPU 80 sets, in step S30, the second amplification factor for abnormal sound determination to the amplifier unit 842, and performs, in step S31, determination of the abnormal sound by causing the abnormal sound determination control unit 75 to acquire the signal level L. In step S32, the CPU 80 determines whether the image formation has ended, that is, whether images have been formed on all the recording materials P in this image formation. Upon determining that the image formation has ended, the CPU 80 ends the processing in FIG. 14. On the other hand, upon determining, in step S32, that the image formation has not ended, the CPU 80 determines, in step S33, whether it is a feed timing of a recording material P. Upon determining that it is not a feed timing of the recording material P, the CPU 80 repeats the processing from step S31. On the other hand, upon determining that it is a feed timing of the recording material P, the CPU 80 repeats the processing from step S25.

As described above, in the present embodiment, as a result of the amplifier unit and the A/D converter unit being used in common between the basis weight detection and the determination of a specific sound, the number of components can be reduced relative to the configurations of the first and second embodiments. Therefore, the cost of the image forming apparatus can further be reduced. Note that the amplifier unit and the A/D converter unit can also be used in common between the double feed detection and the determination of a specific sound. With this, the number of components can be reduced relative to the configuration of the third embodiment, and the cost can be reduced. Note that a configuration may be adopted in which only the amplifier unit is used in common, and the A/D converter unit is not used in common.

OTHER EMBODIMENTS

The first embodiment and the third embodiment can also be combined. That is, a configuration may be adopted in which the receiving unit is shared between the basis weight detection and the double feed detection, and the basis weight, the double feed, and the specific sound are detected using one receiving unit. Also, the present invention can also be realized as a sheet conveyance apparatus that conveys sheets such as recording materials P. The sheet conveyance apparatus has a function of detecting the basis weight of a recording material P to be conveyed and/or a function of detecting the double feed. Also, the sheet conveyance apparatus performs determination of a specific sound using the receiving unit for detecting the basis weight of a recording material P and the double feed. Also, the sonic wave to be transmitted from the transmitting unit 31 may include components in an audible band.

Also, each of the amplifier units in the first to fourth embodiments may have a plurality of amplification factors. For example, the configuration may be such that when a sound having a high sound pressure is to be detected, a low amplification factor is selected, and when a sound having a low sound pressure is to be detected, a high amplification factor is selected. With this, appropriate amplification factors can be set to the amplifier units 732 and 842 in accordance with the member whose state is to be determined, specifically, the specific sound to be determined.

Also, some of the functions of the abnormal sound determination control unit 70, e.g., the functional blocks after the reference A/D value setting unit 734, can be provided in a processing system (processing apparatus) outside the image forming apparatus. That is, the present invention can be realized as an image forming system including the image forming apparatus 1 and a processing system that are connected via a network. In this case, the image forming apparatus 1 transmits information indicating the sound received by the receiving unit 71, e.g., a digital value, to the processing system via the network. Also, the processing system determines the signal level L based on the information received from the image forming apparatus 1, and determines the state of a member of the image forming apparatus 1, specifically, whether or not the member generates a specific sound based on the signal level L. Note that the specific sound is a sound generated when the member has failed or a sound generated when the member has reached a predetermined lifetime, for example. Therefore, in this case, the processing for determining the state of a member that is to be executed by the control unit 3 (or CPU 80) in the embodiments described above is to be performed by the processing system. Upon determining the member that generates a specific sound, the processing system notifies the image forming apparatus 1 or a service center of this fact. With this, the image forming apparatus 1 performs processing in accordance with the determined member and processing for notifying the user.

The processing system or processing apparatus outside the image forming apparatus can perform higher level processing than the image forming apparatus itself, e.g., fast Fourier transform and the like, and therefore can detect a specific sound at a higher accuracy. Also, the abnormal sound determination control unit 70 can also be realized by a circuit that realizes a specific function (e.g., ASIC). Also, when a processing system or a processing apparatus is provided outside the image forming apparatus, the processing in the processing system or the processing apparatus can be realized by a computer program. That is, the above-described processing for determining whether or not the specific sound is occurring in a member can be realized by one or more processors reading out and executing a program.

The present invention is not limited to the above embodiments, and various changes and modifications can be made within the spirit and scope of the invention. Therefore, claims have been made to apprise the public of the scope of the present invention.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-058899, filed on Mar. 26, 2019, which is hereby incorporated by reference herein in its entirety.

What is claimed is:

1. An image forming apparatus comprising:

a plurality of members for forming an image;

a transmitting unit configured to transmit a sonic wave;

a receiving unit configured to receive a first sonic wave that has been transmitted from the transmitting unit and has passed through a sheet and a second sonic wave that is generated from at least one of the plurality of members;

a detection unit configured to detect information regarding a type or state of the sheet based on the first sonic wave; and a determination unit configured to determine a state of a member that has generated the second sonic wave based on the second sonic wave.

2. The image forming apparatus according to claim 1, wherein the determination unit determines the state of the member that has generated the second sonic wave when the transmitting unit does not transmit the sonic wave.

3. The image forming apparatus according to claim 1, wherein the determination unit determines the state of the member that has generated the second sonic wave based on the second sonic wave when the image forming apparatus is in operation.

4. The image forming apparatus according to claim 1, wherein the determination unit retains determination information indicating a correspondence relationship between a member whose state is to be determined and an operating state of the image forming apparatus, and determines the state of the member whose state is to be determined using a receiving result of the receiving unit when the image forming apparatus is in the operating state corresponding to the member, as a receiving result of the second sonic wave obtained by the receiving unit.

5. The image forming apparatus according to claim 4, further comprising:

a feeding unit configured to feed a sheet to a conveyance path; and a conveyance unit configured to convey the sheet fed to the conveyance path by the feeding unit downstream of the conveyance path, wherein the determination unit cuts off a rotary drive force to the feeding unit, and determines a state of the feeding unit based on a receiving result of the receiving unit when the sheet to be conveyed by the conveyance unit is being drawn out from the feeding unit, in accordance with the determination information.

6. The image forming apparatus according to claim 4, further comprising:

a conveyance unit configured to convey a sheet along a conveyance path; and an image formation unit configured to form an image on the sheet conveyed by the conveyance unit, wherein the determination unit determines a state of a roller of the conveyance unit or the image formation unit based on a receiving result of the receiving unit when the roller is rotating, but the conveyance unit is not conveying the sheet or a conveyance sound of the sheet received by the receiving unit is lower than the second sonic wave by a predetermined value or more, in accordance with the determination information.

7. The image forming apparatus according to claim 4, further comprising:

a conveyance unit configured to convey a sheet along a conveyance path; and an image formation unit configured to form an image on the sheet conveyed by the conveyance unit, wherein the image formation unit includes an image carrier on which the image to be transferred to the sheet is formed, and a cleaning unit that cleans the image carrier, and the determination unit determines a state of the cleaning unit based on a receiving result of the receiving unit when the conveyance unit is not conveying the sheet or a conveyance sound of the sheet received by the receiving unit is lower than the second sonic wave by a predetermined value or more, in accordance with the determination information.

8. The image forming apparatus according to claim 4, further comprising a driving unit configured to drive at least one of the plurality of members, wherein the determination unit determines a state of the driving unit based on a receiving result of the receiving unit when the driving unit is being driven, in accordance with the determination information.

9. The image forming apparatus according to claim 8, further comprising a plurality of driving units, wherein the determination unit determines a state of one driving unit, of the plurality of driving units, based on a receiving result of the receiving unit when the one driving unit is being driven, in accordance with the determination information.

10. The image forming apparatus according to claim 4, wherein the receiving unit outputs a signal indicating a received sonic wave, and the determination information indicates a correspondence relationship between a member whose state is to be determined and a filter to be applied to the signal indicating the second sonic wave that the receiving unit has output.

11. The image forming apparatus according to claim 1, wherein the determination unit determines, as the state of the member, whether or not the member is normal, or whether or not the member has reached its lifetime.

12. The image forming apparatus according to claim 11, further comprising a control unit configured to perform, when the determination unit determines that the member that has generated the second sonic wave is not normal, or the member that has generated the second sonic wave has reached its lifetime, control in accordance with the member, wherein the control in accordance with the member includes control so as to reduce the second sonic wave generated from the member or control so as to perform notification regarding the member.

13. The image forming apparatus according to claim 1, wherein the transmitting unit transmits an ultrasonic wave, the first sonic wave is an ultrasonic wave, and the second sonic wave is a sonic wave in an audible range.

14. The image forming apparatus according to claim 1, wherein the receiving unit is configured to be able to receive both of an ultrasonic wave and a sonic wave in an audible range.

15. The image forming apparatus according to claim 1, wherein the receiving unit includes a MEMS microphone, and the MEMS microphone includes:

a vibrating membrane that vibrates in accordance with a received sonic wave; and an electrode that is provided so as to oppose the vibrating membrane, and outputs a signal corresponding to a vibrating state of the vibrating membrane, and the MEMS microphone converts a change in capacitance of a capacitor formed by the vibrating membrane and the electrode to an electric signal.

16. The image forming apparatus according to claim 1, wherein the detection unit detects a basis weight of the sheet as the type of the sheet, or detects a double feed of the sheet as the state of the sheet.

17. The image forming apparatus according to claim 1, further comprising:

an amplifier unit configured to amplify a signal indicating a received sonic wave that the receiving unit outputs; and a setting unit configured to set a first amplification factor to the amplifier unit when the detection unit detects the type or state of the sheet, and set a second amplification factor to the amplifier unit when the determination unit determines the state of a member, wherein the second amplification factor is smaller than the first amplification factor.

18. The image forming apparatus according to claim 17, wherein the setting unit selects the second amplification factor to be set to the amplifier unit from a plurality of amplification factors in accordance with a member whose state is to be determined by the determination unit.

19. The image forming apparatus according to claim 17, wherein the signal output from the amplifier unit can be output to both of the detection unit and the determination unit.

20. The image forming apparatus according to claim 17, further comprising a converter unit configured to convert the signal output from the amplifier unit to a digital signal, wherein a digital signal output from the converter unit can be output to both of the detection unit and the determination unit.

21. An image forming method comprising:

receiving a first sonic wave through a sheet while a transmitting unit is transmitting a sonic wave;

detecting information regarding a type or state of the sheet based on the first sonic wave received in the receiving; and determining a state of a member that has generated a second sonic wave based on the second sonic wave received in the receiving.

22. An image forming system including an image forming apparatus and a processing system that can communicate with the image forming apparatus via a network, wherein the image forming apparatus includes:

a plurality of members for forming an image;

a transmitting unit configured to transmit a sonic wave;

a receiving unit configured to receive a first sonic wave that has been transmitted from the transmitting unit and has passed through a sheet and a second sonic wave that is generated from at least one of the plurality of members;

a detection unit configured to detect information regarding a type or state of the sheet based on the first sonic wave received by the receiving unit; and a transmitting unit configured to transmit information indicating the second sonic wave received by the receiving unit to the processing system, and the processing system includes a determination unit configured to determine a state of a member that has generated the second sonic wave based on the information indicating the second sonic wave.

* * * * *